US005619016A

United States Patent [19]

Newmoyer

[11] Patent Number: 5,619,016

[45] **Date of Patent: *Apr. 8, 1997**

[54] COMMUNICATION CABLE FOR USE IN A PLENUM

[75] Inventor: Kerry Newmoyer, Denver, Pa.

[73] Assignee: Alcatel NA Cable Systems, Inc., Claremont, N.C.

[ * ] Notice: The term of this patent shall not extend beyond the expiration date of Pat. No. 5,493,071.

[21] Appl. No.: 381,315

[22] Filed: Jan. 31, 1995

[51] Int. Cl.[6] ..... H01B 11/02

[52] U.S. Cl. ..... 174/113 R; 174/121 A

[58] Field of Search ..... 174/113 R, 34, 174/121 A; 385/106

[56] References Cited

U.S. PATENT DOCUMENTS

| | | | |
|---|---|---|---|
| 3,489,844 | 1/1970 | Motley | 174/32 |
| 3,650,827 | 3/1972 | Brown et al. | 117/218 |
| 4,412,094 | 10/1983 | Dougherty et al. | 174/110 |
| 4,423,589 | 1/1984 | Hardin et al. | 57/293 |
| 4,446,689 | 5/1984 | Hardin et al. | 57/204 |
| 4,500,748 | 2/1985 | Klein | 174/121 |
| 4,605,818 | 8/1986 | Arroyo et al. | 174/107 |
| 4,687,294 | 8/1987 | Angeles | 350/96.23 |
| 4,755,629 | 7/1988 | Beggs et al. | 174/34 |
| 4,941,729 | 7/1990 | Hardin et al. | 350/96.23 |
| 4,969,706 | 11/1990 | Hardin et al. | 350/96.23 |
| 5,001,304 | 3/1991 | Hardin et al. | 174/107 |
| 5,010,210 | 4/1991 | Sidi et al. | 174/34 |
| 5,015,800 | 5/1991 | Vaupotic et al. | 174/34 |
| 5,024,506 | 6/1991 | Hardin et al. | 30/96.23 |
| 5,074,640 | 12/1991 | Hardin et al. | 385/109 |
| 5,155,789 | 10/1992 | Le Noane et al. | 385/106 |
| 5,162,609 | 11/1992 | Adriaenssens et al. | 174/34 |
| 5,202,946 | 4/1993 | Hardin et al. | 385/109 |
| 5,253,317 | 10/1993 | Allen et al. | 385/109 |
| 5,281,764 | 1/1994 | King et al. | 174/112 |
| 5,424,491 | 6/1995 | Walling et al. | 174/113 |
| 5,493,071 | 2/1996 | Newmoyer | 124/113 R |

FOREIGN PATENT DOCUMENTS

| | | |
|---|---|---|
| 0380245 | 1/1990 | European Pat. Off. . |
| 2518621 | 10/1976 | Germany . |

OTHER PUBLICATIONS

Berk–Tek Product Specification, Drawing Number 230042, Part Number BTTB–24–25D–P/HX, Dated Aug. 12, 1987, pp. 1–3.

Essex Group, Inc. Bulletin 2021–0391, Inside Premises Wiring, 1991.

Underwriters Laboratories Inc., File #107869, Project 90ME13368, Report on Communications Cable, Teledyne Thermatics, Elm City, NC, Sep. 25, 1990.

Underwriters Laboratories Inc., File E113333, vol. 1, Sec. 14, Report on a Communication Cable, Issued Jul. 12, 1991, Revised Jan. 17, 1995 pp. 1–2.

Teledyne Thermatics, Elm City, North Carolina, Type 2 Data & Telephone Plenum Cable, Drawing No. 12632/3, dated May 16, 1990, pp. 1–3.

Champlain Cable Corp. News Release, Notice #4, dated Feb. 8, 1990.

Journal of Vinyl Technology, vol. 7, No. 3, Sep. 1985 pp. 107–111.

International Wire & Cable Symposium Proceedings 1987, Reduced Emissions, Plenum Cable Jacket Compounds, M.J. Keogh, pp. 592–597.

*Primary Examiner*—Kristine L. Kincaid
*Assistant Examiner*—Marc D. Machtinger
*Attorney, Agent, or Firm*—Ware, Fressola, Van Der Sluys & Adolphson

[57] ABSTRACT

A communication cable includes one or more first twisted pairs of electrical conductors, each electrical conductor being surrounded by a layer of a first plenum rated insulating material. The cable also includes one or more second twisted pair of electrical conductors, each electrical conductor thereof being surrounded by a layer of a second plenum rated insulating material. The first and second plenum rated insulating materials are different.

17 Claims, 2 Drawing Sheets

COMMUNICATION CABLE FOR USE IN A PLENUM

BACKGROUND OF THE INVENTION

The present invention generally relates to a communication cable for use in a plenum and, in particular, relates to one such communication cable having one or more first twisted pairs of electrical conductors having a first insulating material about each electrical conductor thereof and one or more second twisted pairs of electrical conductors having a second insulating material about each electrical conductor thereof wherein the first and second insulating materials are different.

As the demands for communication services have increased, it has become necessary to provide communication cables in larger and larger numbers. This is particularly true in office buildings where more and more communication services are being demanded. Typically, rather than rewire an entire existing building, it has been found more economical to provide the needed communication services by running the requisite communication cables in plenums. In general, a plenum is defined as a compartment or chamber to which one or more air ducts are connected and which forms part of the air distribution system of the structure. Generally, in existing buildings, communication cables are readily provided within the areas above drop ceilings in the portions of the facility being rewired. These plenums are, typically, return air plenums. Alternatively, plenums can also be created beneath a raised floor of a facility.

From the above it can be readily understood why it would be very advantageous to utilized a wiring scheme within these fairly accessible places. However, since these plenums handle environmental air, considerable concern regarding a fire incidence is addressed in the National Electrical Code by requiring that communication cables for use in plenums pass a stringent flame and smoke tests. Consequently, in the manufacture of communication cables the fire resistance ratings that allow for installation within certain areas of a building, particularly plenums, are of primary importance.

Currently, communication cables for use in plenums must meet the requirements of the Underwriter's Laboratory Standard 910 which is entitled Test Method For Fire and Smoke Characteristics of Cables Used In Air-Handling Spaces. This is a well known test performed in a modified Steiner Tunnel. During the test, a single layer of 24 foot lengths of cable are supported on a one foot wide cable rack that is filled with cables. The cables are ignited with a 300,000 Btu/hr methane flame located at one end of the furnace for a duration of 20 minutes. Flame spread within the tunnel is aided by a 240 ft/minute draft. Flame spread is then monitored through observation windows along the side of the tunnel. Concurrently, smoke emissions are monitored through the use of photocells installed within the exhaust duct. This is a severe test that to date has been passed only by communication cables using premium materials such as low smoke materials, for example, Fluroethylenepropylene (FEP), Ethylene-chlorotrifluoroethylene (ECTFE), or Polyvinylidene fluoride (PVDF). In general, communication cables passing this test are approximately three times more expensive than lower rated cables designed for the same communication application. However, communication cables falling this test must be installed within conduit, thereby eliminating the benefits of an economical, easily relocatable cable scheme.

In general, the manufacture of communication cables are well known, for example, U.S. Pat. No. 4,423,589, issued to Hardin et al. on Jan. 3, 1984 discloses a method of manufacturing a communication cable by forming a plurality of wire units by advancing groups of twisted wire pairs through twisting stations. Further, U.S. Pat. No. 4,446,689 issued to Hardin et al. on May 8, 1984 relates to an apparatus for manufacturing a communication cable wherein disc frames are provided with aligned apertures in which faceplates movably mounted. During operation, the faceplates are modulated in both frequency and amplitude.

The current materials for use in communications are also well known, for example, U.S. Pat. No. 5,001,304 issued to Hardin et al. on Mar. 19, 1991 relates to a building riser cable having a core which includes twisted pairs of metal conductors. Therein the insulating covers are formed from a group of materials including polyolefin. It should be noted however, that all of the insulating covers are the same and that the flame test used for riser cables is much less severe than the flame test used for plenum cables.

U.S. Pat. No. 5,024,506 issued to Hardin et al. on Jun. 18, 1991 discloses a plenum cable that incudes non-halogenated plastic materials. The insulating material about the metallic conductors is a polyetherimide. Again the insulating material is the same for all of the conductors. Further, in U.S. Pat. No. 5,074,640 issued to Hardin et al. on Dec. 24, 1991 a plenum cable is described that includes an insulator containing a polyetherimide and an additive system including an antioxidant/thermal stabilizer and a metal deactuator. As is the convention, the insulator is the same for all of the metallic conductors.

U.S. Pat. No. 5,202,946 issued to Hardin et al. on Apr. 13, 1993 describes a plenum cable wherein the insulation includes a plastic material. The insulation is the same for all of the conductors within the plenum cable. European Patent 0 380 245 issued to Hardin et al. describes another plenum cable having insulation about the metallic conductors that, in this case, is a plastic material including a polyetherimide. As is the convention the insulation is the same for all of the metallic conductors.

Further, U.S. Pat. No. 4,941,729 describes a cable that is intended as a low hazard cable. This patent describes a cable that includes a non-halogenated plastic material. Similarly, U.S. Pat. No. 4,969,706 describes a cable that includes both halogenated and non-halogenated plastic materials. In both patents the insulating material about the twisted pairs of conductors is the same for each cable.

U.S. Pat. No. 4,412,094 issued to Doughrety et al. on Oct. 25, 1983 relates to a riser cable having a composite insulator having an inner layer of expanded polyethylene and an outer layer of a plasticized polyvinyl chloride. All of the conductors include the same composite insulator.

U.S. Pat. No. 4,500,748 issued to Klein on Feb. 19, 1985 relates to a flame retardant plenum cable wherein the insulation and the jacket are made from the same or different polymers to provide a reduced amount of halogens. This reference tries to predict, mathematically, the performance of cables within the Steiner tunnel. The method does not include fuel contributions or configurations of designs. Further, synergistic effects are not addressed. In each embodiment, the insulation is the same for all of the conductors.

U.S. Pat. No. 4,605,818 issued to Arroyo et al. on Aug. 12, 1986 relates to a flame retardant plenum cable wherein the conductor insulation is a polyvinyl chloride plastic provided with a flame retardant, smoke suppressive sheath system. As is common throughout the known communication cables the conductor insulation is the same for all of the conductors.

U.S. Pat. No. 4,678,294 issued to Angeles on Aug. 18, 1987 relates to a fiber optic plenum cable. The optical fibers are provided with a buffer layer surrounded by a jacket. The cable is also provided with strength members for rigidity.

U.S. Pat. No. 5,010,210 issued to Sidi et al. on Apr. 23, 1991 describes a non-plenum telecommunications cable wherein the insulation surrounding each of the conductors is formed from a flame retardant polyolefin base compound.

U.S. Pat. No. 5,162,609 issued to Adriaenssens et al. on Nov. 10, 1992 relates to a fire-resistant non-plenum cable for high frequency signals. Each metallic member has an insulation system. The insulation system includes an inner layer of a polyolefin and an outer layer of flame retardant polyolefin plastic.

U.S. Pat. No. 5,253,317 issued to Allen et al. on Oct. 12, 1993 describes a non-halogenated plenum cable including twisted pairs of insulated metallic conductors. The insulating material is a non-halogenated polyethersulfone polymer composition. The insulating material is the same for all of the metallic conductors.

It can thus be understood that much time and resources have been dedicated to providing not only communication cables that meet certain safety requirements but adequately meet the electrical requirements as well. Nevertheless, the most common communication cable in use today includes a plurality of twisted pairs of electrical conductors each having an insulation of FEP, which is a very high temperature material and possesses those electrical characteristics, such as, low dielectric constant and dissipation factor, necessary to provide high quality communications cable performance. However, FEP is quite expensive and is frequently in short supply.

Consequently, the provision of a communication cable for use in plenums but has a reduced cost and reduced use of FEP is highly desired.

SUMMARY OF THE INVENTION

Accordingly, it is one object of the present invention to provide a communication cable for use in a plenum which reduces the amount of FEP or other expensive materials and hence, reduces the cost of the communication cable.

This object is accomplished, at least in part by a communication cable that has one or more first twisted pairs of electrical conductors having a first insulating material about each electrical conductor thereof and one or more second twisted pairs of electrical conductors having a second insulating material about each electrical conductor thereof wherein the first and second insulating materials are different.

In one particular aspect of the invention, the communication cable includes four twisted pairs of electrical conductors wherein the electrical conductors of three of the four pairs are insulated with the first material that is a plenum rated insulating material whereas the insulation of the electrical conductors of the fourth pair of twisted conductors is a second material that is also a plenum rated insulating material. As used herein the phrase "plenum rated insulating material", as well as the idiomatic variations thereof, includes those materials that would allow a cable to pass standard industry plenum tests if it were used on all of the twisted pairs of electrical conductors of a cable.

In another aspect of the invention, the communication cable includes a large number of twisted pairs of electrical conductors including one or more first twisted pairs of electrical conductors wherein the insulation material of each of the first plurality of twisted pairs of conductors is a material conventionally used in plenum cables. In this aspect of the invention, the communication cable also includes one or more second twisted pairs of conductors having an insulation that is a different plenum rated insulation material from the insulation of the one or more first twisted pairs of electrical conductors.

Other objects and advantages will become apparent to those skilled in the art from the following detailed description of the invention read in conjunction with the appended claims and the drawings attached hereto.

BRIEF DESCRIPTION OF THE DRAWING

The drawings, not drawn to scale, include.

DETAILED DESCRIPTION OF THE PREFERRED EMBODIMENT

Figure 1:
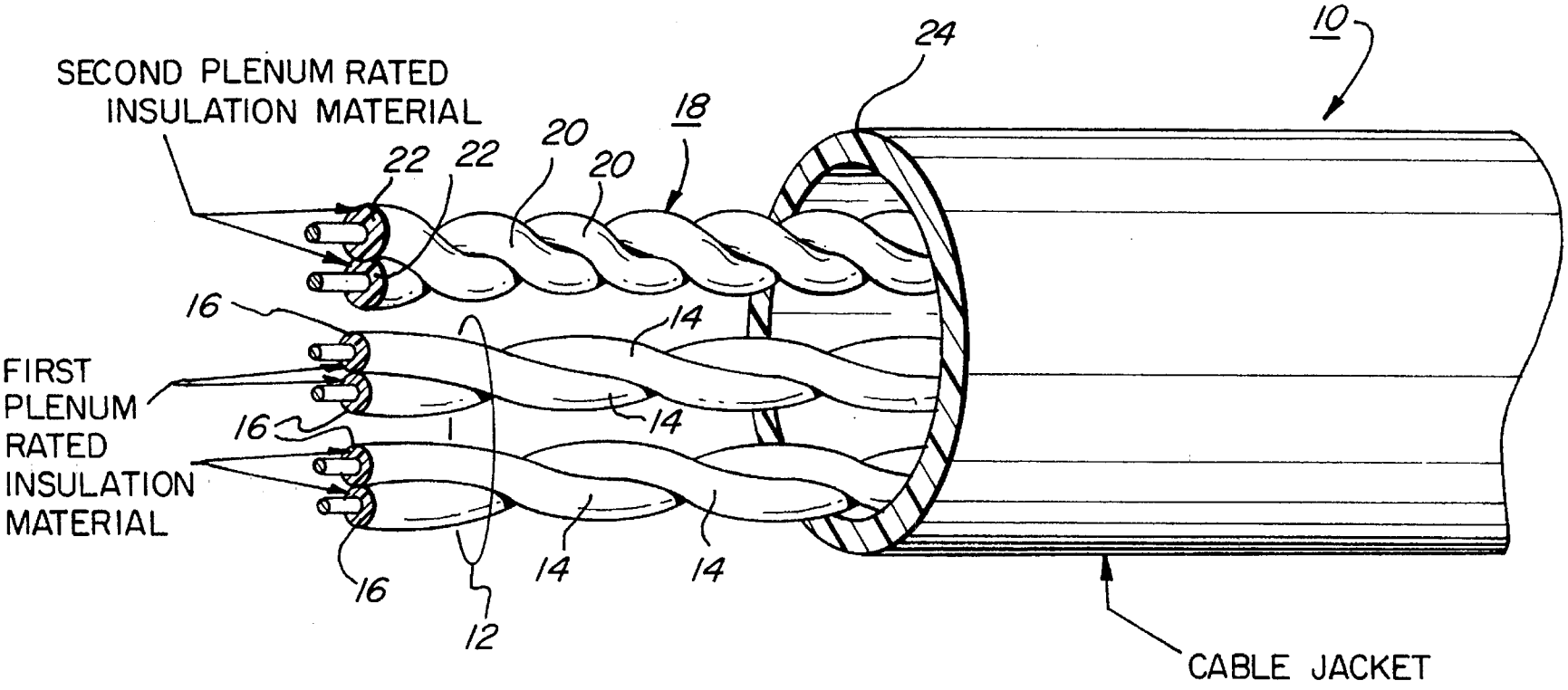
FIG. 1 which is a perspective view of a communication cable embodying the principles of the present invention.

A communication cable, generally indicated at 10 in FIG. 1 and embodying the principles of the present invention, includes one or more first twisted pairs 12 of electrical conductors wherein each member 14 of the first twisted pairs 12 is provided with a layer 16 of insulating material and one or more second twisted pairs 18 of electrical conductors wherein each member 20 thereof is provided with a layer 22 of insulating material that is different from the material of the layer 16 of insulation material of the twisted pairs 12. In one preferred embodiment, the first twisted pairs 12 and the second twisted pairs 18 are surrounded by a cable jacket 24.

In one specific embodiment, the first twisted pairs 12 of electrical conductors of the communication cable 10 each have a nominal diameter of about 0.034 inches. This includes a metallic electrical conductor having a nominal diameter of about 0.0205 inches and a layer 16 of insulation material having a thickness of about 0.0065 inches. For the first twisted pairs 12 of electrical conductors the layer 16 of insulation material can be any plenum rated insulation, such as, for example, FEP. In this particular embodiment, each of the second twisted pairs 18 of electrical conductors has a nominal diameter of about 0.205 inches. This includes a metallic electrical conductor having a nominal diameter of about 0.0085 inches and a layer 22 of insulating material having a thickness of about 0.0085 inches. Typically, the electrical conductors will be copper or aluminum although other electrically conductive metals may also be used.

Preferably, the layer 22 of insulating material of the second twisted pairs 18 is also a plenum rated insulating material and, in this particular embodiment, is either a polyetherimide or a polyethersulfone. For example, one such polyetherimide insulating material 22 may be a material commonly referred to as ULTEM, a registered trademark of the General Electric Company. As another example, the insulation layer 22 may also be a polyethersulfone material. These insulating materials are well known in the electrical cable industry and further detailed discussion thereof is not believed necessary for a complete understanding of the present invention.

It has also been found that the configuration set forth in this particular embodiment does not compromise the desired electrical performance of the communication cable 10. In fact, the standard FEP four pair cable has a weakness in the typical design in that the twisted pairs having the shorter twist lengths, i.e., the tighter twists, generally approaches the signal attenuation failure limit. Usually this is within about 2% of the passing level. Such electrical performance concerns are particularly exhibited at higher frequencies, i.e., on the order of 100 MHz or greater as future uses evolve. Hence, any process changes must be limited on these twisted pairs to avoid any distortional stresses during manufacture that would lower the characteristic impedance of the twisted pair and thus raise the signal attenuation. It has been found that when these comparatively tighter twisted pair are provided with the polyetherimide or polyethersulfone insulation material the signal attenuation is improved compared to the standard FEP insulation. Hence, it is preferred that the second twisted pairs 18 be used for the comparatively tighter twisted pairs and the first twisted pairs 12 be used for the comparatively looser twisted pairs. Although the flame retardancy and smoke characteristics of the polyetherimide or polyethersulfone materials is less desirable than FEP, the use of such materials has been found to not only improve the electrical parameters of the cable 10 but reduce the manufacturing cost as well. It has also been found that with the polyetherimide or polyethersulfone materials, the use of FEP on the first twisted pairs 12 compensates for the flame and smoke deficiencies of the polyetherimide and polyethersulfone. Preferably, half of the twisted pairs of the cable 10 are provided with the FEP insulation and the other half of the twisted pairs of the cable 10 are provided with the polyetherimide or polyethersulfone insulation. It will be understood that any combination of first twisted pairs 12 and second twisted pairs 18 can be included within the cable 10 so long as the final combination passes the requisite tests.

In the preferred embodiment, the communication cable 10 is also provided with a cable jacket 24 that encases the plurality of twisted pairs 12 and the at least one twisted pair 18. Preferably, the cable jacket 24 is formed from Ethylene-Trichlorofluoroethylene (E-CTFE). Although the E-CTFE is preferred, other material, such as, for example, polyvinylchloride (PVC) or polymer alloys have also passed the modified Steiner tunnel test and may also be used. Preferably, the cable jacket 24 has a nominal thickness of about 0.015 inches.

Figure 2:
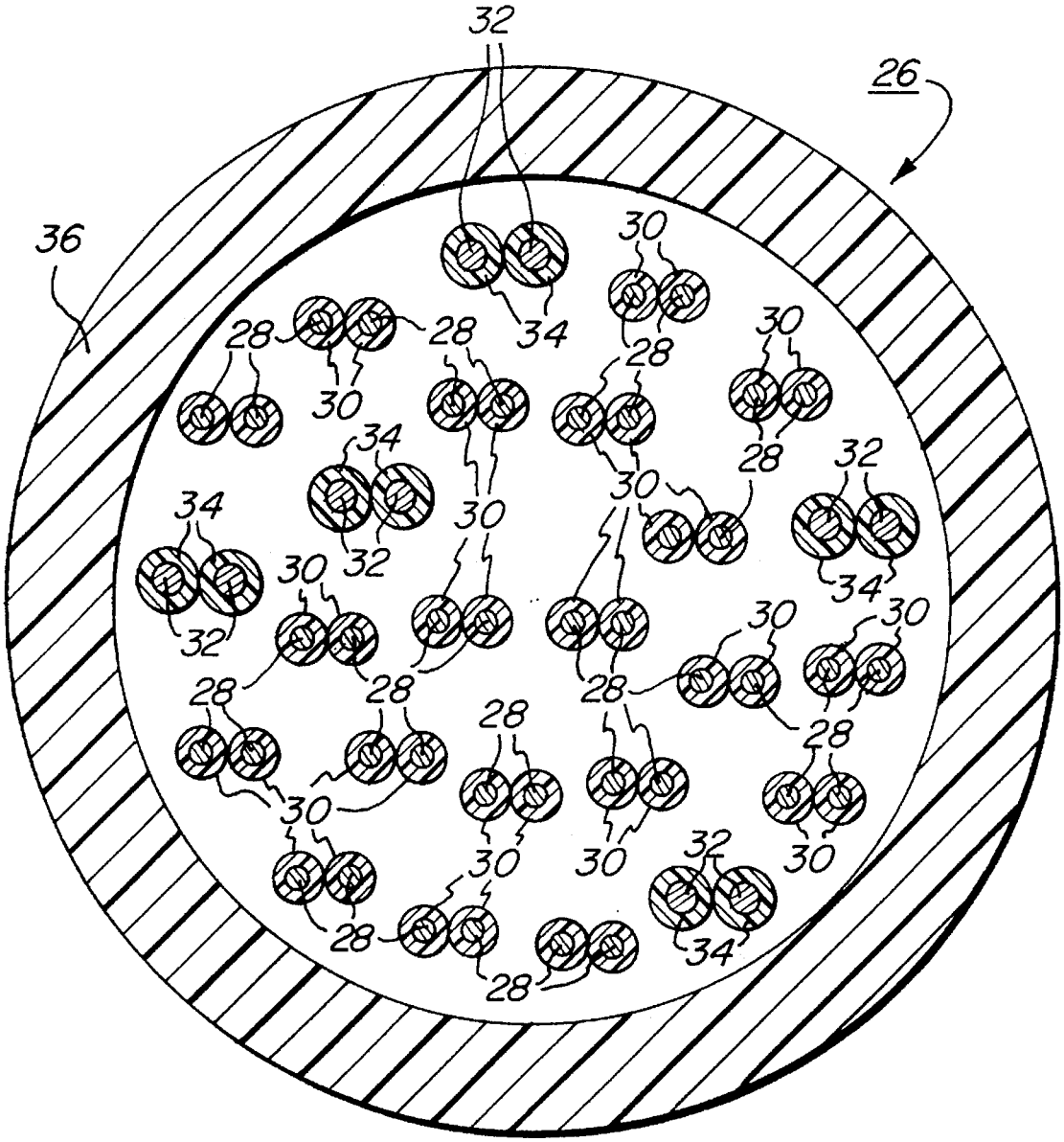
FIG. 2 which is an end view of another communication cable also embodying the principles of the present invention.

Another communication cable, generally indicated at 26 in FIG. 2 and embodying the principles of the present invention, includes a first plurality of twisted pairs 28 of electrical conductors having a first insulating material 30 about each electrical conductor thereof and a second plurality of twisted pairs 32 of electrical conductors having a second insulating material 34 about each electrical conductor thereof. The communication cable 26 also includes a cable jacket 36 that encases the first and second plurality of twisted pairs, 28 and 34, respectively. The cable jacket 36 is similar to the cable jacket 24 of the communication cable 10 previously described hereinabove and can be formed of the same materials.

The communication cable 26 differs from the previously discussed communication cable 10 primarily in the number of first and second twisted pairs, 28 and 34, respectively. Typically, such a communication cable 26 has a total of about 25 twisted pairs and is typically used for main cabling functions whereas the communication cable 10 includes about 4 twisted pairs and is used primarily for individual service connections. Naturally, the communication cables, 10 and 26, can include any number of twisted pairs and the present invention is not limited to the specific numbers of twisted pairs recited herein.

As a result of the use of different insulating materials for different ones of the twisted pairs of a communication cable, 10 or 26, the cost of manufacturing such a cable, 10 or 26, can be significantly reduced. That is, because polyetherimide and polyethersulfone materials are less expensive than other plenum rated materials, for example, FEP, the cost of the communication cable, 10 or 26, is reduced when some of the twisted pairs employ these insulating materials. Clearly, the larger the number of second twisted pairs used within a cable the less costly the cable. Hence, the number of such second twisted pairs used is primarily dependent on the ability of the cable to pass the requisite industry tests.

Although the present invention has been discussed with respect to one or more specific embodiments it will be understood that other configurations and arrangements may be used which do not exceed the spirit and scope hereof. Hence, the present invention is limited only by the appended claims and the reasonable interpretation thereof.

What is claimed is:

1. A communication cable for use in a plenum, said cable comprising:

one or more first twisted pairs of electrical conductors, each electrical conductor of said one or more first twisted pairs having a surrounding layer of electrical insulation formed from a first plenum rated insulating material;

one or more second twisted pairs of electrical conductor, each electrical conductor of said one or more second twisted pairs having a surrounding layer of electrical insulation formed from a second plenum rated insulating material selected from the group consisting of polyetherimide and polyethersulfone, said second plenum rated insulating material being different from said first material; and a cable jacket, said cable jacket encasing said first and second twisted pairs of electrical conductors.

2. The communication cable as claimed in claim 1 wherein said cable jacket is formed from a polymer alloy.

3. The communication cable as claimed in claim 1 wherein said cable jacket is formed from polyvinylchloride.

4. The communication cable as claimed in claim 1 wherein said cable jacket has a nominal thickness of about 0.015 inches.

5. The communication cable as claimed in claim 1 wherein the number of said first twisted pairs is equal to the number of said second twisted pairs.

6. The communication cable as claimed in claim 1 wherein said second twisted pairs are comparatively tighter twisted pairs than said first twisted pairs.

7. The communication cable as claimed in claim 1 wherein the sum of said first twisted pairs and said second twisted pairs is four.

8. The communication cable as claimed in claim 1 wherein the sum of said first twisted pairs and said second twisted pairs is twenty-five.

9. The communication cable as claimed in claim 1 wherein said cable jacket is formed from ethylenetrichlorofluoroethylene.

10. The communication cable as claimed in claim 1 wherein said first plenum rated insulating material is a fluorine based plenum rated insulating material.

11. The communication cable as claimed in claim 1 wherein said first plenum rated insulating material is selected from the group consisting of fluroethylenepropylene, ethylenechlorotrifluorothylene, and polyvinylidene fluoride.

12. A communication cable for use in a plenum, said cable comprising:

one or more first twisted pairs of electrical conductors, each electrical conductor of said one or more first twisted pairs having a surrounding layer of electrical insulation formed from a first plenum rated insulating material which is a fluorine based plenum rated insulating material;

one or more second twisted pairs of electrical conductor, each electrical conductor of said one or more second twisted pairs having a surrounding layer of electrical insulation formed from a second plenum rated insulating material which is a polyetherimide; and a cable jacket, said cable jacket encasing said first and second twisted pairs of electrical conductors.

13. The communication cable as claimed in claim 12 wherein said first plenum rated insulating material is selected from the group consisting of fluroethylenepropylene, ethylenechlorotrifluorothylene, and polyvinylidene fluoride.

14. The communication cable as claimed in claim 12 wherein said cable jacket is formed from a polymer alloy.

15. The communication cable as claimed in claim 12 wherein said cable jacket is formed from polyvinylchloride.

16. The communication cable as claimed in claim 12 wherein said cable jacket is formed from ethyleneTrichlorofluoroethylene.

17. The communication cable as claimed in claim 12 wherein said cable jacket has a nominal thickness of about 0.015 inches.

* * * * *